US010549556B2

(12) United States Patent
Kubo

(10) Patent No.: US 10,549,556 B2
(45) Date of Patent: Feb. 4, 2020

(54) PRINTER AND CONTROL METHOD FOR PRINTER

(71) Applicant: SATO HOLDINGS KABUSHIKI KAISHA, Tokyo (JP)

(72) Inventor: Yoshimasa Kubo, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/321,099

(22) PCT Filed: Jul. 12, 2017

(86) PCT No.: PCT/JP2017/025442
§ 371 (c)(1),
(2) Date: Jan. 28, 2019

(87) PCT Pub. No.: WO2018/061406
PCT Pub. Date: Apr. 5, 2018

(65) Prior Publication Data

US 2019/0168518 A1 Jun. 6, 2019

(30) Foreign Application Priority Data

Sep. 29, 2016 (JP) ..... 2016-191011

(51) Int. Cl.
*B41J 11/42* (2006.01)
*B41J 2/32* (2006.01)
(Continued)

(52) U.S. Cl.
CPC ..... *B41J 11/42* (2013.01); *B41J 2/32* (2013.01); *B41J 11/0095* (2013.01); *B41J 11/04* (2013.01); *B41J 3/4075* (2013.01); *B41J 15/04* (2013.01)

(58) Field of Classification Search
CPC . B41J 11/02; B41J 11/04; B41J 11/053; B41J 11/057; B41J 11/06; B41J 11/08;
(Continued)

(56) References Cited

U.S. PATENT DOCUMENTS 7,922,409 B2 4/2011 Murahashi
9,132,674 B2 9/2015 Nagaoka
(Continued)

FOREIGN PATENT DOCUMENTS

JP 4-286666 A 10/1992
JP 06-286239 A 10/1994
(Continued)

OTHER PUBLICATIONS

Extended European Search Report, Application No. 17855364.0, dated Aug. 28, 2019, 9 pages.

*Primary Examiner* — Kristal Feggins
(74) *Attorney, Agent, or Firm* — Foley & Lardner LLP

(57) ABSTRACT

To use roll paper up to a terminal end of a last printing sheet and prevent the printing sheet from dropping after printing on the last printing sheet in a printer, the last printing sheet is stopped such that a side downstream of the terminal end of the last printing sheet in a feeding direction is located at a nipping position where the printing sheet is nipped by a thermal head and a platen roller if the terminal end of the last printing sheet in the roll paper is detected.

5 Claims, 13 Drawing Sheets

(51) Int. Cl.

| | |
|---|---|
| ***B41J 11/00*** | (2006.01) |
| ***B41J 11/04*** | (2006.01) |
| *B41J 15/04* | (2006.01) |
| *B41J 3/407* | (2006.01) |

(58) Field of Classification Search
CPC ..... B41J 11/10; B41J 11/13; B41J 11/0075; B41J 15/042
See application file for complete search history.

(56) References Cited

U.S. PATENT DOCUMENTS

| | | | | |
|---|---|---|---|---|
| 2005/0206715 | A1* | 9/2005 | Sasaki | B41J 11/0075 347/221 |
| 2014/0227017 | A1* | 8/2014 | Kanda | B41J 29/38 400/611 |
| 2018/0326759 | A1* | 11/2018 | Kitahara | B41J 11/46 |

FOREIGN PATENT DOCUMENTS

| | | | |
|---|---|---|---|
| JP | 9-128655 | A | 5/1997 |
| JP | 2003-335008 | A | 11/2003 |
| JP | 2007-098882 | A | 4/2007 |
| JP | 2007-276173 | A | 10/2007 |
| JP | 2011-156683 | A | 8/2011 |
| JP | 2015-066719 | A | 4/2015 |

* cited by examiner

PRINTER AND CONTROL METHOD FOR PRINTER

TECHNICAL FIELD

The present invention relates to a printer for printing a predetermined content on continuous paper of printing sheets and a control method for printer.

BACKGROUND ART

In a cashless register, a receipt printed with information such as prices of purchased products and the name of a store is issued. Further, when a credit card is used, a copy printed with a card number, a usage charge and the like is issued. Since the receipt includes information having high confidentiality such as personal information as just described, cares are required so as not to easily separate or drop a receipt from continuous paper after printing.

As an example, a receipt printer has been proposed in which a receipt is cut and fed out from an issue port after printing is performed on a receipt continuous paper and which can hold a cut receipt in the issue port by providing a mechanism for pressing the cut receipt (see JP9-128655A).

A technique described in JP9-128665A relates to a stationary cashless register. In contrast, portable cashless registers having a similar configuration are also utilized.

As an example of a portable device, a meter reading device for reading the use amount of electricity, gas, water or the like is formed in a size easily carried around by a meter reader and includes a printer capable of printing a meter reading content.

SUMMARY OF INVENTION

Since a meter reader is used particularly outdoors and prints more specific personal information than a receipt, an issued printing sheet should be more carefully handled. However, in the case of a portable device such as a meter reader, it is not desired to install a pressing mechanism as described in JP9-128665A in terms of miniaturization and weight saving.

Further, the drop of a last printing sheet can be prevented, for example, if a terminal end side of the last printing sheet normally provided as continuous paper is held inside a printer. However, it is desired to use the continuous paper up to the terminal end of the last printing sheet in terms of reducing environmental burdens.

Accordingly, the present invention aims to use roll paper up to a terminal end of a last printing sheet and prevent the drop of the printing sheet after printing on the last printing sheet in a printer for printing on the roll paper formed by winding continuous paper of printing sheets sectioned at predetermined intervals.

One aspect of the present invention is directed to a printer for printing on roll paper formed by winding continuous paper of printing sheets sectioned at predetermined intervals, the printer including a thermal head configured to print on the printing sheet, a platen roller provided to face the thermal head, the platen roller being configured to nip the printing sheet between the thermal head and the platen roller and feed the printing sheet, a detection unit provided upstream of the platen roller in a feeding direction of the printing sheets, the detection unit being configured to detect the printing sheet, and a control unit configured to stop the last printing sheet such that a downstream side of a terminal end of the last printing sheet in the feeding direction is located at a nipping position where the printing sheet is nipped by the thermal head and the platen roller after the last printing sheet is fed if the terminal end of the last printing sheet in the roll paper is detected by the detection unit.

According to the above aspect, the roll paper can be used up to the terminal end of the last printing sheet and the printing sheet does not drop after printing on the last printing sheet in the printer for printing on the roll paper formed by winding the continuous paper of the printing sheets sectioned at the predetermined intervals.

DESCRIPTION OF EMBODIMENT

[Printer]

<Overall Configuration of Printer>

Figure 1:
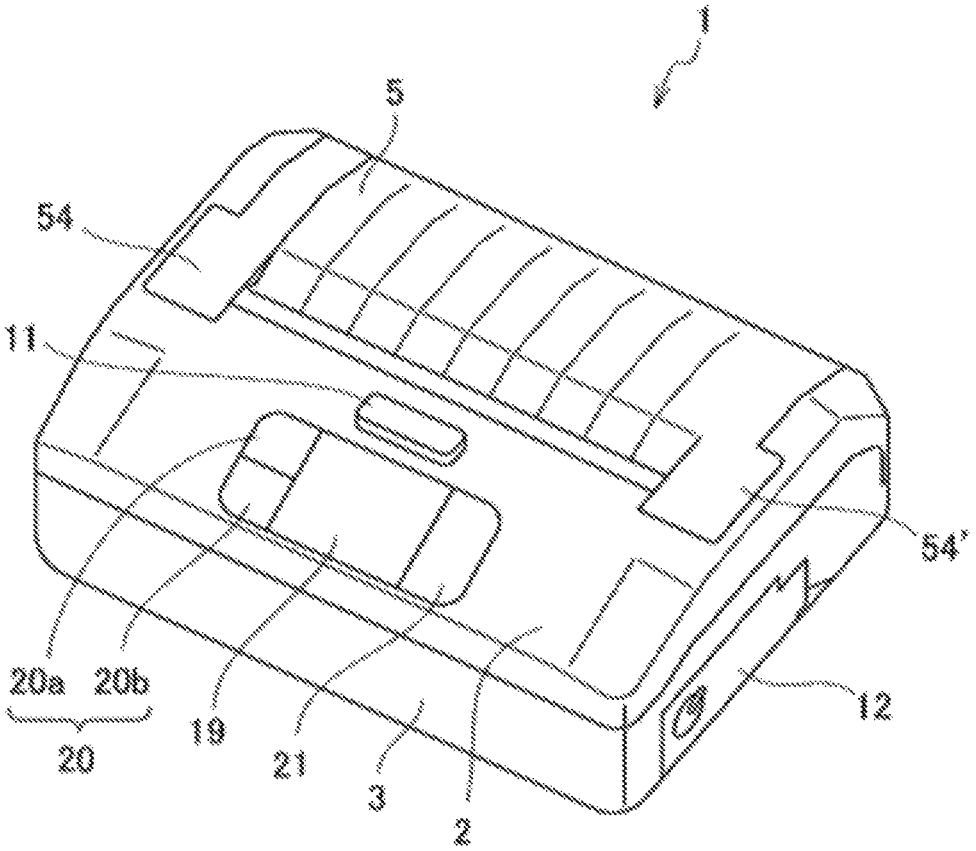
FIG. 1 is an external perspective view of a printer according to an embodiment of the present invention.
Figure 2:
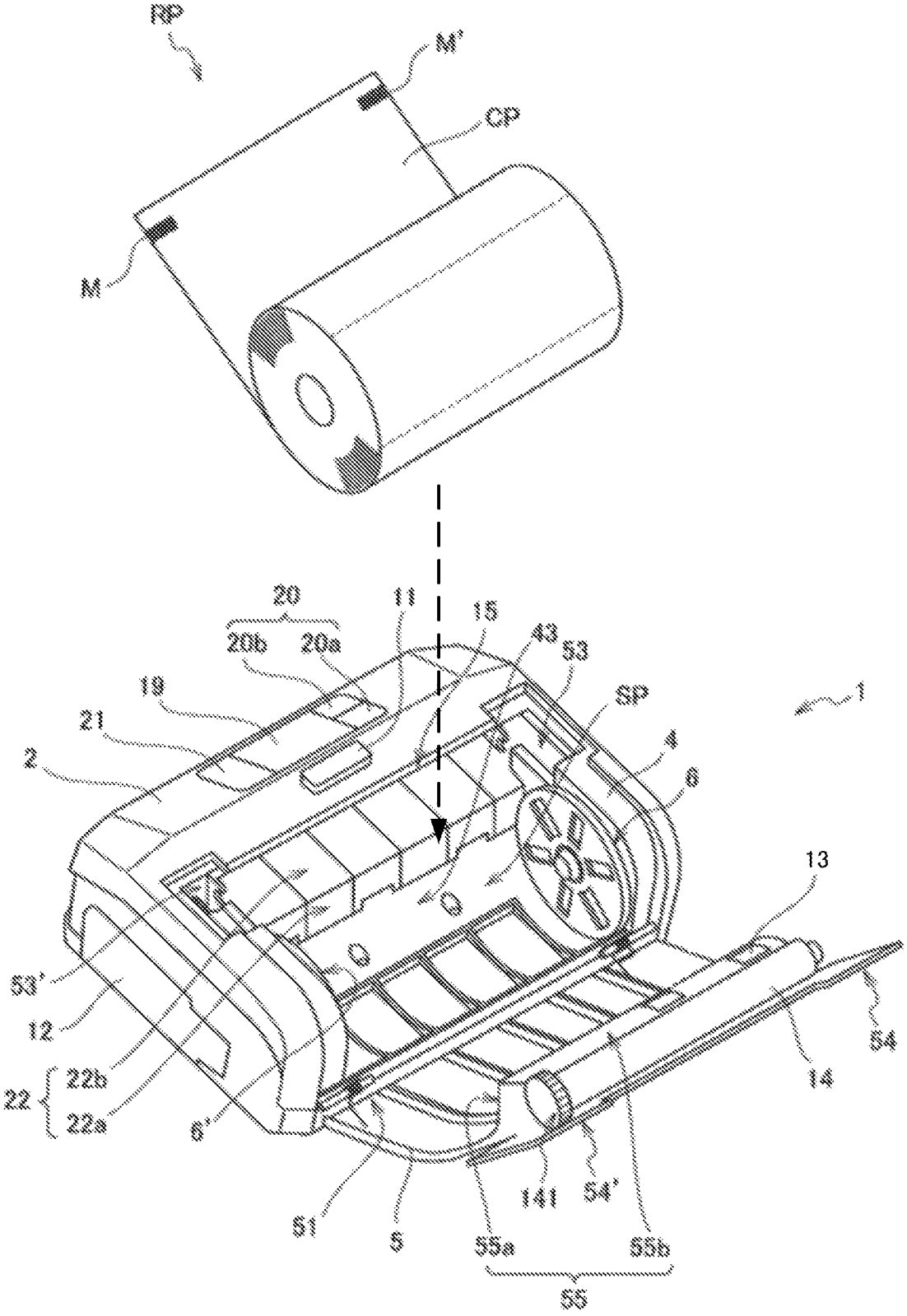
FIG. 2 is a perspective view showing, together with roll paper RP, a state where an opening/closing cover of the printer according to the embodiment of the present invention is opened.
Figure 3:
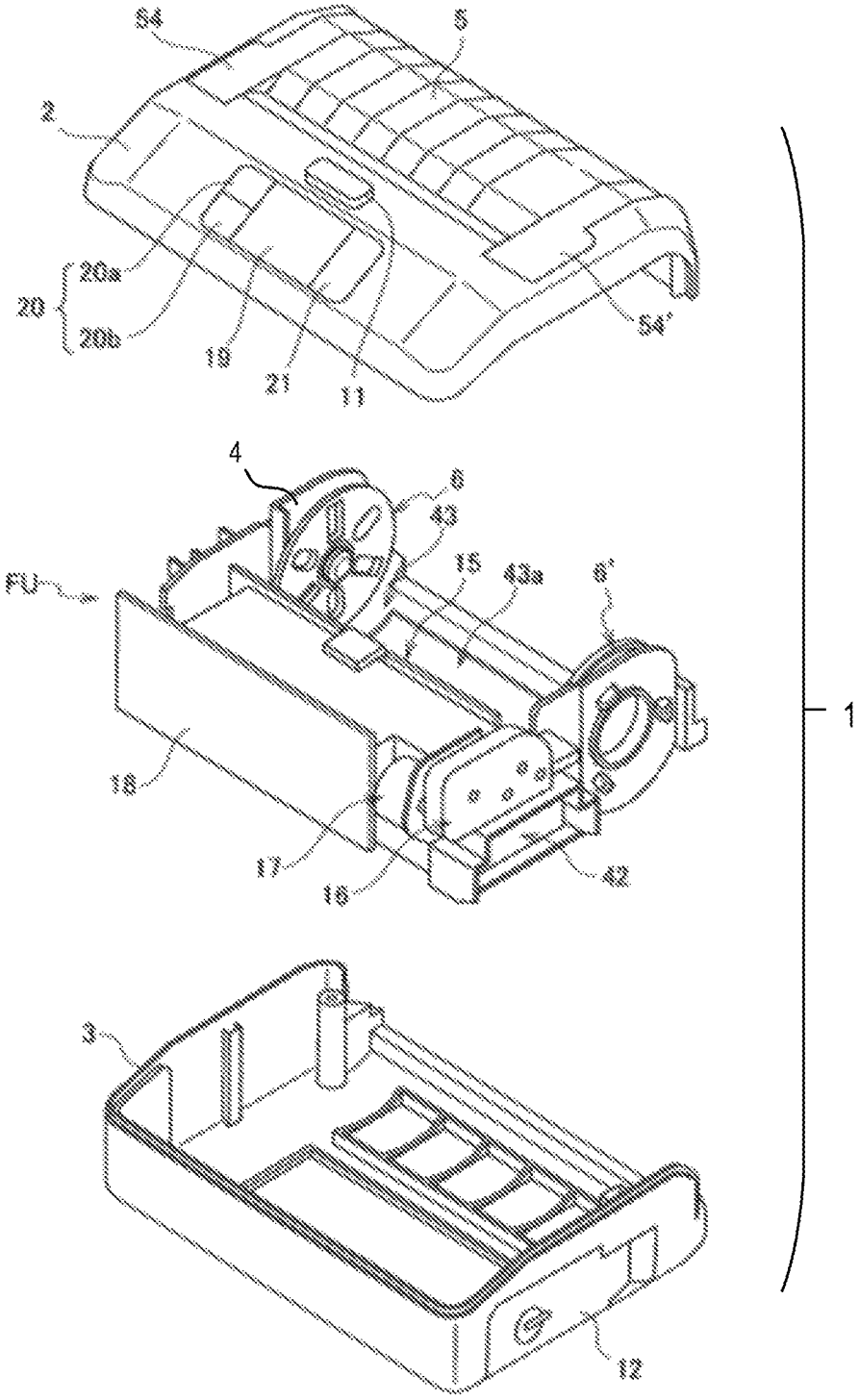
FIG. 3 is an exploded perspective view showing a schematic configuration of a housing of the printer according to the embodiment of the present invention.
Figure 4:
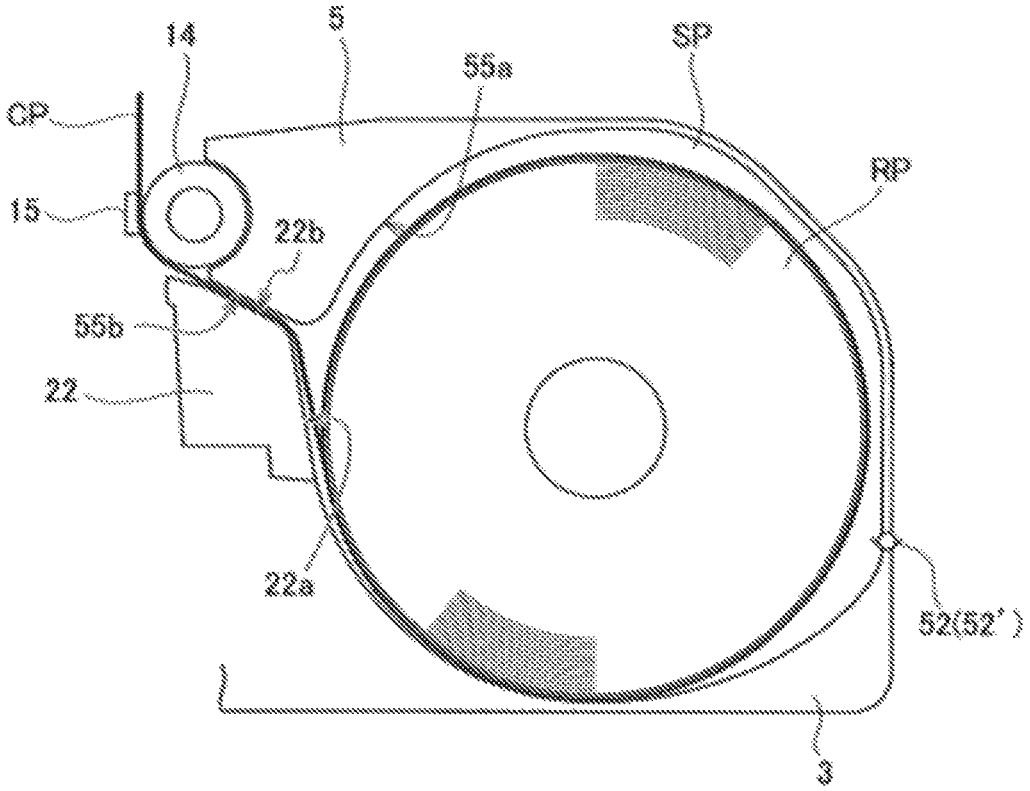
FIG. 4 is a view showing a paper passage route of the printer according to the embodiment of the present invention.

Hereinafter, a printer 1 according to an embodiment of the present invention is described in detail with reference to the drawings. FIG. 1 is an external perspective view of the printer 1 according to the present embodiment. FIG. 2 is a perspective view showing, together with roll paper RP, a state where an opening/closing cover 5 of the printer 1 is opened. FIG. 3 is an exploded perspective view showing a schematic configuration of a housing of the printer 1 of the present embodiment. FIG. 4 is a view showing a paper passage route of the printer 1 of the present embodiment.

The printer 1 according to the present embodiment is a printer for printing on a printing surface of the roll paper RP obtained by winding continuous paper CP of printing sheet PS sectioned at predetermined intervals. The printer 1 includes a thermal head 15 configured to print on the printing sheet PS, a platen roller 14 provided to face the thermal head 15 and configured to nip the printing sheet PS between the thermal head 15 and the platen roller 14 and feed the printing sheet PS in a feeding direction, a sensor 13 provided upstream of the platen roller 14 in the feeding direction of the printing sheets PS and serving as a detection unit for detecting the printing sheet PS, and a control unit MC configured to stop the last printing sheet PS such that a downstream side of a terminal end SE of the last printing sheet PS in the feeding direction is located at a nipping position NA where the printing sheet PS is nipped by the thermal head 15 and the platen roller 14 if the terminal end SE of the last printing sheet PS in the roll paper RP is detected by the sensor 13.

As shown in FIG. 3, a front cover 2 and a body case 3 of the printer 1 are fixed to each other by screws (not shown). In the printer 1, a frame 4 equipped with a functional unit FU is sandwiched between the front cover 2 and the body case 3. The functional unit FU is protected by the front cover 2 and the body case 3. Further, the frame 4 is fixed to the body case 3 by unillustrated screws.

As shown in FIGS. 1 to 3, the front cover 2 in the printer 1 includes an opening push-button 11, a display unit 19, an operation button group 20 including operations buttons 20*a*, 20*b* and a power supply switch 21. Further, an opening/closing cover 5 for opening or closing a housing chamber SP for housing the roll paper RP to be described later is mounted on the front cover 2.

The opening push button 11 is a button for opening the opening/closing cover 5. The display unit 19 is a screen for displaying operation commands, messages and the like and, for example, an LCD (Liquid Crystal Display). The opening push buttons 20*a*, 20*b* are buttons for an operator to instruct an operation of the printer 1. The power supply switch 21 is a button for turning on or off a power supply of the printer 1.

As shown in FIGS. 1 and 3, the body case 3 is coupled to the front cover 2 and forms a printer housing together with the front cover 2. As shown in FIG. 3, the frame 4 having the functional unit FU of the printer 1 disposed therein is fastened to the body case 3 by screws (not shown).

As shown in FIGS. 1 to 3, a battery cover 12 is mounted in an openable/closable state on the body case 3. Further, the battery cover 12 is an opening/closing cover of a battery housing 42 (see FIG. 3) of the frame 4 for housing a battery (not shown) serving as a power supply.

Further, the frame 4 is formed with a bottom surface 43 of the housing chamber SP. The bottom surface 43 of the housing chamber SP is curved in an arched manner to face the opening/closing cover 5 and be concave toward the opening/closing cover 5 when the opening/closing cover 5 is closed. The bottom surface 43 of the housing chamber SP is formed with an opening 43*a* for weight saving.

Detection marks M, M' indicating print reference positions at specific intervals are provided on the back side of a printing surface of continuous paper CP of the print sheets PS. A thermosensitive color-developing layer which develops a specific color when a predetermined temperature region is reached is formed on the printing surface of the continuous paper CP of the printing sheets PS. The continuous paper CP of the printing sheets PS is described in detail later.

As shown in FIGS. 2 and 3, the frame 4 forms a part of the housing chamber SP for the roll paper RP. Further, a pair of roll paper guide portions 6, 6' for supporting lateral parts (i.e. both widthwise end surfaces) of the roll paper RP from both sides in the housing chamber SP are mounted in the frame 4. The roll paper guide portions 6, 6' guide both side surfaces of the roll paper RP while making the roll paper RP free to rotate.

As shown in FIG. 2, the roll paper RP used in the printer 1 is loaded into the housing chamber SP with the opening/closing cover 5 of the printer 1 opened, and supported by center shafts of the roll paper guide portions 6, 6'.

As shown in FIG. 3, the functional unit FU includes the thermal head 15, a gear group 16, a stepping motor 17 and a circuit board 18.

The thermal head 15 includes a heating element for applying heat to the thermosensitive color-developing layer on the printing surface of the continuous paper CP of the printing sheets PS fed by the platen roller 14 for printing. The thermal head 15 is provided to face the platen roller 14 with the opening/closing cover 5 closed.

The platen roller 14 feeds the printing sheet PS toward an issue port. Further, the platen roller 14 is mounted in a state free to rotate in both forward and reverse directions with a rotary shaft serving as a center. The platen roller 14 is disposed in a state pressed against a printing part of the thermal head 15 at a predetermined pressure.

A surface of the platen roller 14 is covered with an elastic material such as hard rubber. Further, the platen roller 14 is engaged with a motor T to be described later via an unillustrated gear.

A controller for controlling a printing operation, an electronic circuit for driving the stepping motor 17 to feed the continuous paper CP of the printing sheets PS, an electronic circuit for driving the heating element of the thermal head 15 and the like are mounted on the circuit board 18.

The opening/closing cover 5 is an opening/closing cover for opening and closing the housing chamber SP and rotatably supported on an opening/closing shaft 51 by a hinge or the like. The opening/closing cover 5 is biased to be in an open state by torsion springs 52, 52' (see FIG. 4) arranged along the opening/closing shaft 51.

As shown in FIG. 2, the opening/closing cover 5 is provided with the platen roller 14 along an axis parallel to the opening/closing shaft 51 near an end part opposite to the opening/closing shaft 51. The platen roller 14 feeds the continuous paper CP of the printing sheets PS fed out from the roll paper RP.

Side pieces 54, 54' are provided on both ends of the opening/closing cover 5. By closing the opening/closing cover 5, coupling spaces 53, 53' (see FIG. 2) can be closed. The coupling spaces 53, 53' are spaces for engaging a platen roller gear 141 of the platen roller 14 with the gear group 16 (see FIG. 3) when the opening/closing cover 5 is closed. By engaging the platen roller gear 141 with the gear group 16, the platen roller 14 is made operable and can print on the printing surface of the continuous paper CP.

As shown in FIGS. 2 and 4, a sensor 13 is disposed on a surface of the opening/closing cover 5 facing a paper passage route when the opening/closing cover 5 is closed.

The sensor 13 is a sensor for detecting a print reference position (i.e. detection marks M, M') provided on the continuous paper CP of the printing sheets PS and constituted by a reflective optical sensor.

The reflective optical sensor includes unillustrated light emitting unit and light receiving unit, wherein the light emitting unit emits light toward the back side of the printing surface of the continuous paper CP of the printing sheets PS and the light receiving unit receives the light reflected from the back side of the printing surface (reflected light).

The light receiving unit photoelectrically converts the reflected light into an electrical signal corresponding to the light intensity (received light amount per unit time) of the reflected light and outputs the electrical signal to the control unit MC (described later) in the circuit board 18. Since reflected light from the black detection marks and reflected light from the surface (e.g. white surface) other than the detection marks differ in level of reflected light, i.e. signal level to be output to the control unit MC, the presence or absence of the detection mark M or the terminal end SE of the printing sheet PS can be determined according to a period during which black is detected during the feed of the printing sheet PS.

It should be noted that an LED (Light Emitting Diode) can be used as the light emitting unit. Further, a photodiode or phototransistor can be used as the light receiving unit.

The determination on the presence or absence of the detection mark M or the terminal end SE of the printing sheets PS by the control unit MC is described later.

The control unit MC in the circuit board 18 controls a printing sheet feed timing and the printing of remaining print data on the basis of a signal level output from a reflective sensor or transmissive sensor.

As shown in FIG. 2, a cover inner surface 55 of the opening/closing cover 5 includes a curved surface 55*a* and a guide surface 55*b* extending along a shaft of the platen roller 14. The aforementioned sensor 13 is mounted on the guide surface 55*b* of the cover inner surface 55. Further, a feed guide unit 22 is fixed to the frame 4. The feed guide unit 22 is formed with a wall surface 22*a* and a guide surface 22*b*.

FIG. 4 shows a part of a schematic lateral cross-section of the printer 1 when the roll paper RP is housed and the opening/closing cover 5 is closed. A paper passage route when the roll paper RP obtained by winding the continuous paper CP of the printing sheets PS is inserted into the housing chamber SP of the printer 1 is shown by a thick line in a side view of the printer 1 in FIG. 4.

As shown in FIG. 4, when the opening/closing cover 5 is closed, the curved surface 55*a* of the opening/closing cover 5 and the wall surface 22*a* of the feed guide unit 22 constitute a part of an inner wall of the housing chamber SP and the guide surface 55*b* of the opening/closing cover 5 and the guide surface 22*b* of the feed guide unit 22 are arranged to face each other with a tiny gap defined therebetween. This gap serves as the paper passage route of the continuous paper CP of the printing sheets PS fed out from the roll paper RP from the housing chamber SP to the platen roller 14.

It should be noted that the sensor 13 is disposed on the guide surface 55*b* of the opening/closing cover 5 in this gap in the paper passage route and detects the detection marks M, M' of the continuous paper CP of the printing sheets PS passing through the gap.

FIG. 4 shows a state where the roll paper RP obtained by winding the continuous paper CP is inserted in the housing chamber SP of the printer 1 in the side view of the printer 1. In the state shown in FIG. 4, a leading end part of the continuous paper CP fed out from the roll paper RP moves toward the platen roller 14 along the gap between the wall surface 22*a* of the feed guide unit 22 and the guide surfaces 22*b* and 55*b*.

Here, the guide surfaces 22*b* and 55*b* are inclined in a direction opposite to a winding direction of the roll paper RP on the basis of the wall surface 22*a*. Thus, natural curling of the continuous paper CP of the printing sheets PS is corrected while moving toward the platen roller 14.

In the printer 1 of the present embodiment, the continuous paper CP of the printing sheets PS fed out from the roll paper RP is fed to the platen roller 14 by the paper passage route shown in FIG. 4 and nipped between the platen roller 14 and the thermal head 15 to perform printing. Then, the continuous paper CP of the printing sheets PS is fed out to the issue port by the rotation of the platen roller 14.

At this time, printing on the printing sheet PS is performed on the basis of the detection marks M, M' detected by the sensor 13.

<Circuit Configuration of Printer>

Figure 5:
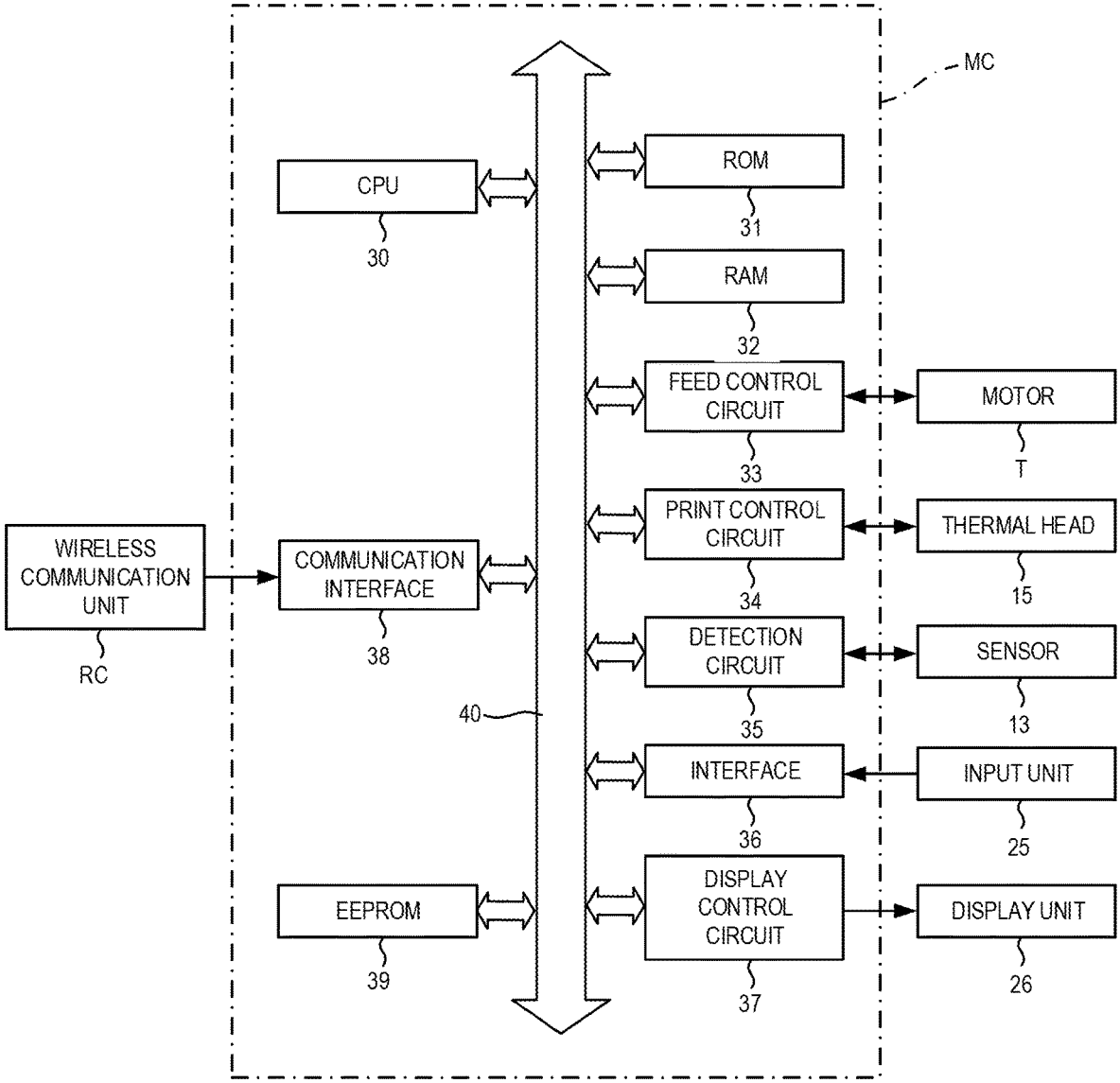
FIG. 5 is a block diagram showing a circuit configuration of an essential part of the printer according to the embodiment of the present invention.

Next, a circuit configuration of the printer 1 of the present embodiment is described. FIG. 5 is a block diagram showing a circuit configuration of an essential part of the printer 1.

The printer 1 according to the present embodiment includes the motor T for driving the platen roller 14 and the thermal head 15 for thermally printing information such as characters, symbols, figures, a bar code and a two-dimensional code in a printing region specified on the printing sheet PS.

The motor T is constituted by a stepping motor and electrically connected to the control unit MC. The control unit MC controls a rotating operation (rotating direction, number of steps, etc.) of the motor T according to print data or the like input to the printer 1.

Further, the printer 1 includes the sensor 13. The sensor 13 detects the detection marks M, M' of the printing sheets or the terminal end SE of the printing sheets as described above. The sensor 13 is electrically connected to the control unit MC and sends a detection signal to the control unit MC.

An input unit 25 is an operating part for receiving an instruction or print data from an operator. The input unit 25 is formed by a plurality of operation keys such as data entry keys, direction indicating keys, a cancel key and an enter key.

A display unit 26 is a part for displaying various messages and the like besides displaying information and a processing mode input by the input unit 25 or the like, and disposed near the input unit 25. This display unit 26 is, for example, formed by an LCD (Liquid Crystal Display).

A wireless communication unit RC is a non-contact input unit for receiving print data (command, print information, etc.) sent from the outside of the printer 1 to the printer 1 by wireless communication using infrared rays or radio waves, and electrically connected to the control unit MC.

The control unit MC is a part for controlling the entire operation of the printer 1 and includes a CPU (Central Processing Unit) 30, a ROM (Read Only Memory) 31 and a RAM (Random Access Memory) 32.

Further, the control unit MC includes a feed control circuit 33, a print control circuit 34, a detection circuit 35, an interface 36, a display control circuit 37, a communication interface 38 and an EEPROM (Electinically Erasable Programmable ROM) 39. These are electrically connected to each other by a bus line 40.

The CPU 30 is electrically connected to the input unit 25 and the display unit 26 through the interface 36 and the display control circuit 37. Further, the CPU 30 can wirelessly communicate with external communication terminals through the communication interface 38.

A program of software (hereinafter, referred to as "firmware") for controlling the operation of the printer 1 and control data to be referred to by the firmware in controlling the operation of the printer 1 are stored in the EEPROM 39.

Print data received via the input unit 25 or the communication interface 38 is stored in the RAM 32.

The CPU 30 realizes functions of the firmware by implementing the program stored in the EEPROM 39. The firmware controls the operation of each part of the printer 1 such as the feed control circuit 33 and the print control circuit 34 by referring to the control data stored in the EEPROM 39.

The feed control circuit 33 sends a pulse signal to the motor T and controls a feeding operation of the printing sheet PS by the platen roller 14.

The print control circuit 34 controls a printing operation by generating a control signal corresponding to the print data sent from the CPU 30 and sending the generated control signal to the thermal head 15.

The detection circuit 35 irradiates light toward the continuous paper CP of the printing sheets PS by controlling the light emitting unit of the sensor 13, receives an electrical signal (detection signal) output from the light receiving unit of the sensor 13, converts the received electrical signal into digital data and sends the converted digital data to the CPU 30 under the control of the CPU 30.

Each part constituting the control unit MC is electrically connected to the CPU 30 through the bus line 40 and performs an operation of printing on the printing sheet PS by the thermal head 15 in accordance with the print data received from the interface 36 or the communication interface 38 under the control of the CPU 30.

Further, the control unit MC of the printer 1 in the present embodiment performs a process of feeding the printing sheet on the basis of a detection result of the sensor 13.

Specifically, the control unit MC stops the last printing sheet PS such that a terminal end side of the last printing sheet PS is located at a nipping position NA where the printing sheet PS is nipped by the thermal head 15 and the platen roller 14 if the terminal end SE of the last printing sheet PS in the roll paper RP is detected by the sensor 13.

Here, the terminal end side is a region outward of a printable region PE and inward of the terminal end SE on the printing sheet PS. Further, the terminal end side includes a region downstream of the terminal end SE of the printing sheets PS in the feeding direction.

Particularly, in the present embodiment, the control unit MC stops the last printing sheet PS such that a downstream side of the terminal end SE in the feeding direction is located at the nipping position NA where the printing sheet PS is nipped by the thermal head 15 and the platen roller 14 if the terminal end SE of the last printing sheet PS is detected by the sensor 13.

Further, the control unit MC feeds the printing sheet PS such that the downstream side of the terminal end SE in the feeding direction is located at the nipping position NA where the printing sheet PS is nipped by the thermal head 15 and the platen roller 14 and stops printing on the printing sheet PS before the printing sheet PS is stopped if the terminal end SE of the last printing sheet PS is detected by the sensor 13.

Further, if the detection mark M for detecting a boundary SB between the printing sheets PS is provided at a predetermined position of the printing sheet PS, the control unit MC feeds and stops the printing sheets PS such that an upstream side of the boundary SB between the printing sheets PS in the feeding direction is located at the nipping position NA where the printing sheet PS is nipped by the thermal head 15 and the platen roller 14 if the detection mark M is detected by the sensor 13.

Furthermore, the control unit MC determines whether or not the remaining print data can be printed on the printable region PE of the printing sheet PS when the upstream side of the boundary SB in the feeding direction is stopped at the nipping position if the detection mark M is detected by the sensor 13, and stops printing on the printing sheet PS if printing is impossible.

The feeding process of the printing sheet PS by the control unit MC is described in detail later.

<Printing Sheet and Roll Paper>

Figure 6:
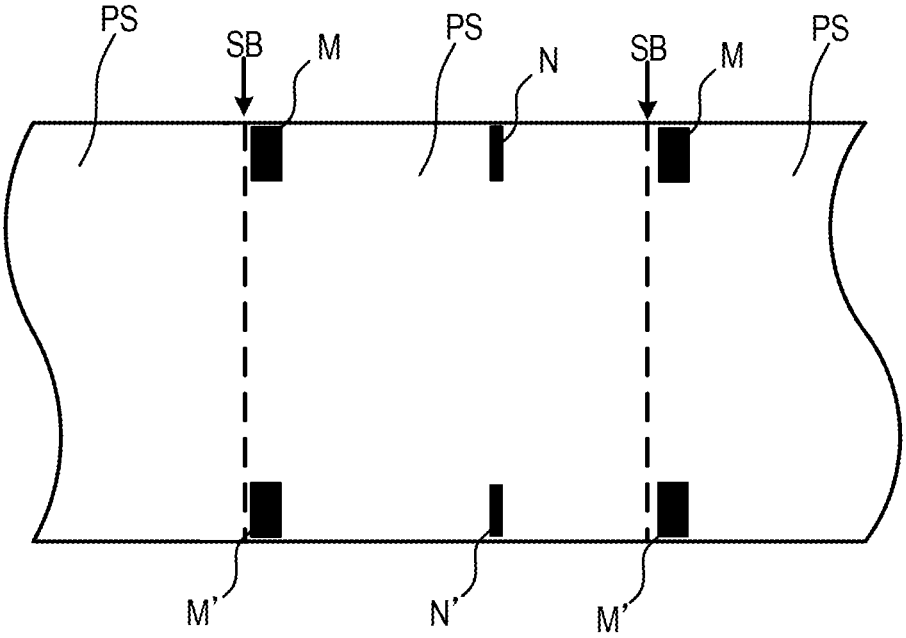
FIG. 6 is a plan view of printing sheets used in the printer according to the embodiment viewed from an opposite side to a printing surface on which printing is performed.

In the present embodiment, the roll paper RP is obtained by winding the continuous paper PC of the printing sheets PS. FIG. 6 is a plan view of the planarly developed continuous paper CP of the printing sheets used in the printer 1 according to present embodiment viewed from an opposite side to the printing surface on which printing is performed.

In the present embodiment, the roll paper RP is of a coreless type. The continuous paper CP is dividable for each printing sheet PS, and perforation may be made on the boundaries SB between the printing sheets PS. In this way, the printing sheet PS after printing can be easily cut off from the roll paper RP.

The printing sheet PS is formed with the detection marks M, M' for confirming a printing position on the opposite side to the printing surface on which printing is performed. In the present embodiment, the detection marks M, M' are rectangular marks printed in black on the back side of the printing surface of the continuous paper CP. The detection marks M, M' are used to determine whether a detected sheet part is the boundary SB between the printing sheets PS in the continuous paper CP or the terminal end SE of the printing sheets PS.

The printing sheet PS may be provided with a plurality of detection marks. As an exemplary case where a plurality of detection marks is provided, designation marks N, N' for designating the printing position of specific print data on the printing sheet PS are shown on the continuous paper CP shown in FIG. 6.

By determining designated print data to be printed on the printing sheet PS in correspondence with the designation marks N, N', the printer 1 can start printing the designated print data when detecting the designation marks N, N'.

[Control Method for Printer]

Next, the sheet feeding process by the control unit MC of the printer 1 is described.

A control method for the printer 1 according to the embodiment of the present invention is a control method for the printer 1 with the thermal head 15 configured to print on the roll paper RP obtained by winding the continuous paper CP of the printing sheets PS sectioned at the predetermined intervals, the platen roller 14 provided to face the thermal head 15 and configured to nip the printing sheet PS between the thermal head 15 and the platen roller 14 and feed the printing sheet PS and the sensor 13 provided upstream of the platen roller 14 in the feeding direction of the printing sheets PS and configured to detect the printing sheet PS, and the last printing sheet PS is stopped such that the downstream side of the terminal end SE in the feeding direction is located at the nipping position NA where the printing sheet PS is nipped by the thermal head 15 and the platen roller 14 if the terminal end SE of the last printing sheet PS in the roll paper RP is detected.

Further, the control method for the printer 1 according to the embodiment of the present invention is designed to stop the printing sheets PS such that the upstream side of the boundary SB between the printing sheets PS in the feeding direction is located at the nipping position NA where the printing sheet PS is nipped between the thermal head 15 and the platen roller 14 when the detection mark M is detected if the detection mark M for detecting the boundary SB between the printing sheets PS is provided at the predetermined position of the printing sheet PS.

<Sheet Feed Modes>

In the present embodiment, the following two modes for feeding sheet are set. Specifically, the two modes are a normal sheet feed mode executed when the printing sheet PS is cut off from the continuous paper CP and a last sheet feed mode executed when the printing sheet PS is the last sheet.

Before the sheet feed modes are described, a method for detecting the terminal end SE of the print sheets and a method for detecting an intermediate part of the continuous paper CP by the printer 1 are described.

Figure 7:
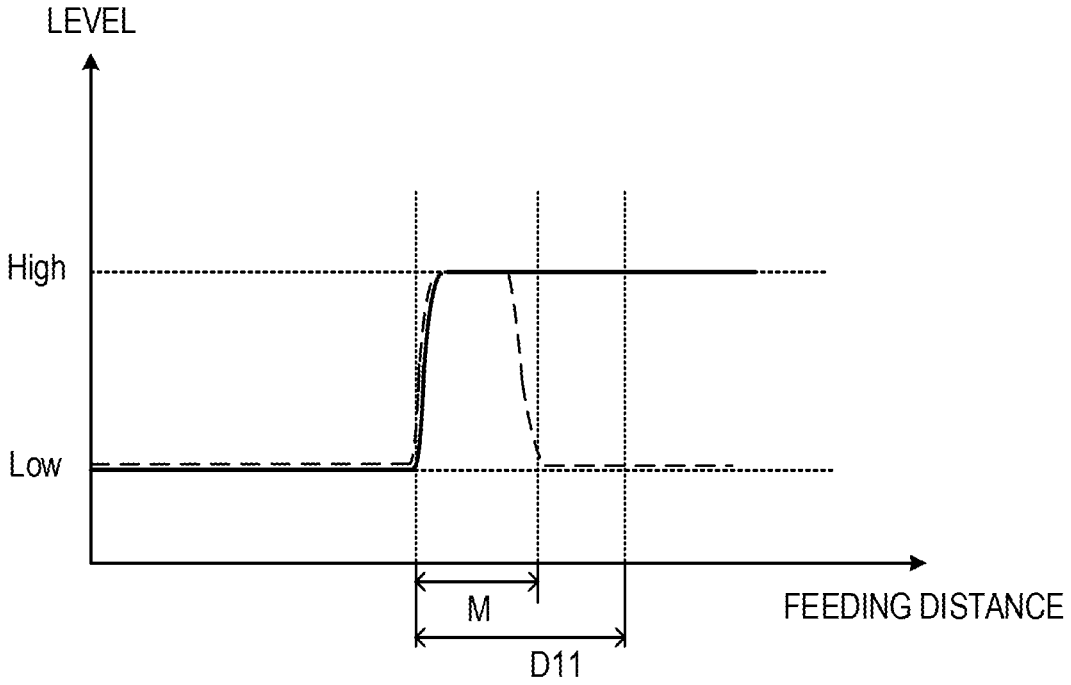
FIG. 7 is a schematic diagram showing a method for detecting a terminal end of the printing sheets in the printer according to the embodiment.

FIG. 7 is a graph showing the method for detecting the terminal end SE of the print sheets PS in the printer 1 according to the present embodiment. A solid line and a broken line in FIG. 7 represent levels of detection light detected by the sensor 13.

The control unit MC determines whether the detected sheet part is the detection marks M, M' or the terminal end SE of the printing sheets PS according to a period during which the level of detection light detected by the sensor 13 and changed from Low to High is maintained High. In FIG. 7, the solid line represents a level change when the terminal end SE of the printing sheets PS is detected, and the broken line represents a level change the detection marks M, M' are detected.

Figure 9:
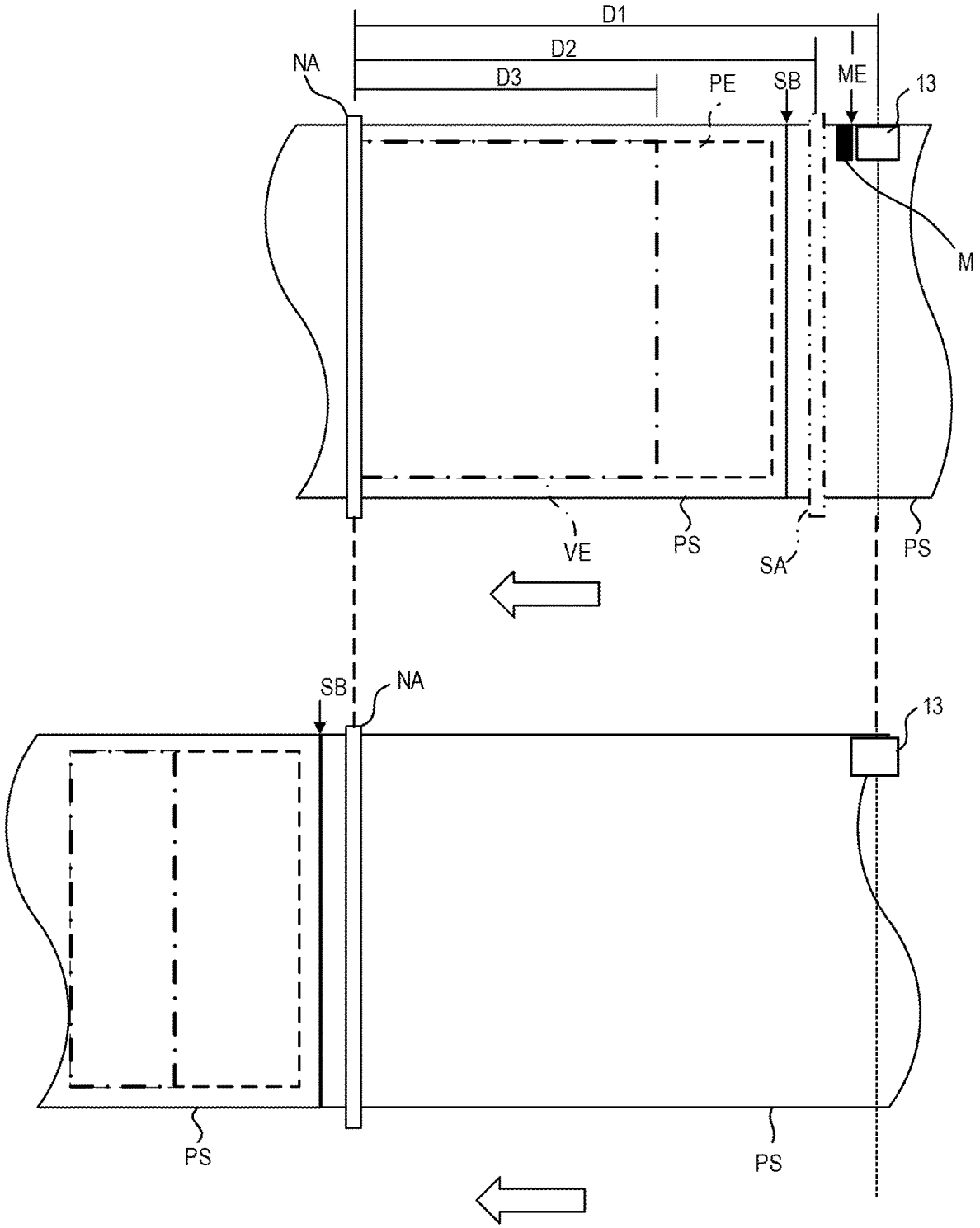
FIG. 9 is a diagram showing the normal sheet feed mode in the printer according to the embodiment.

When the terminal end SE of the printing sheets PS is detected, the above period is a period during which the last printing sheet PS is fed a distance D11 in FIG. 9. For the detection of the terminal end SE of the printing sheets PS, a period longer than the detection marks M, M' and clearly distinguishable from the detection marks M, M' can be set as a reference.

Figure 8:
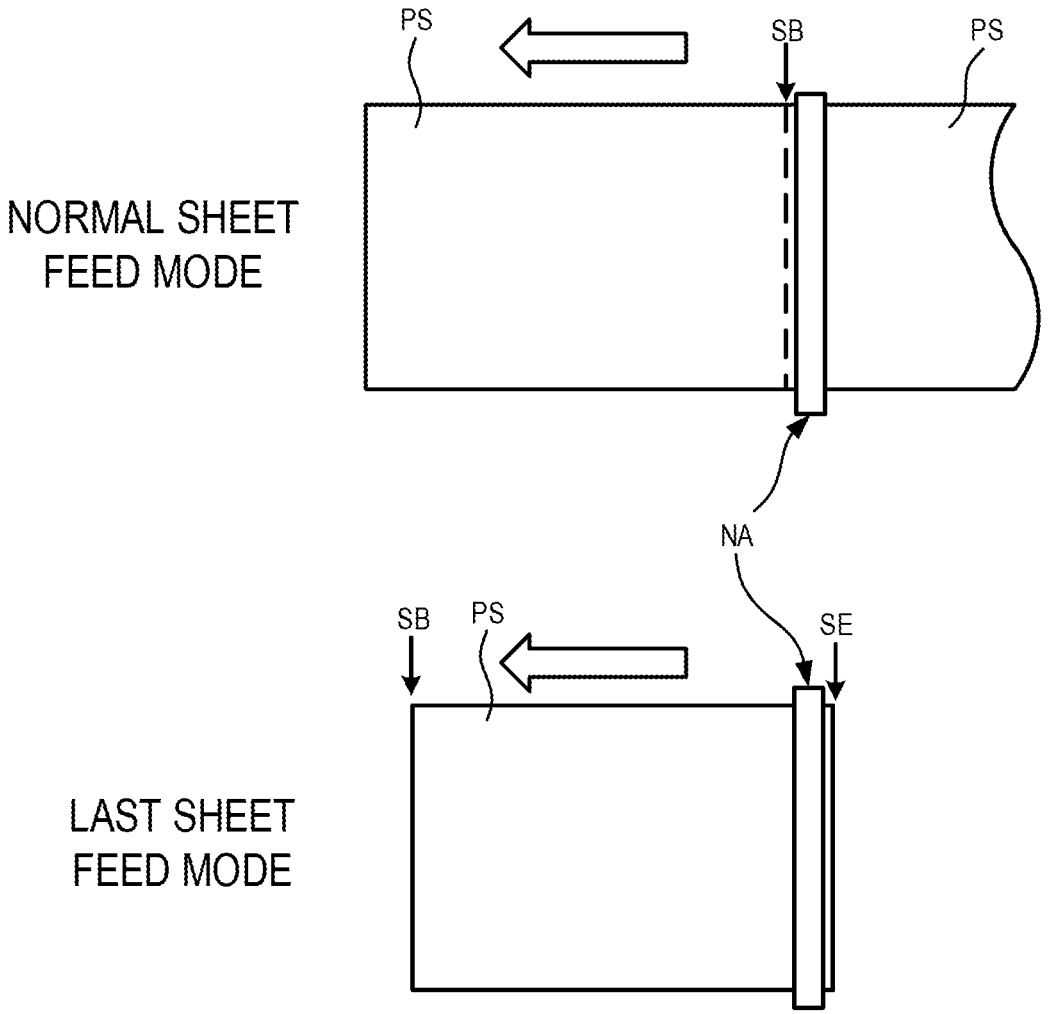
FIG. 8 is a diagram showing a state where sheet feed is stopped by each of a normal sheet feed mode and a last sheet feed mode in the printer according to the embodiment.

Next, FIG. 8 is a diagram showing a state where the sheet feed is stopped by each of the normal sheet feed mode and the last sheet feed mode in the printer 1 according to the present embodiment. In FIG. 8, a direction of a white arrow indicates the feeding direction of the printing sheets PS (continuous paper CP).

In the present embodiment, the normal sheet feed mode is a mode in which the continuous paper CP is stopped such that the nipping position NA where the printing sheet PS is nipped by the thermal head 15 and the platen roller 14 is located upstream of the boundary SB between the printing sheets PS in the feeding direction. In FIG. 8, a stopped state in the normal sheet feed mode is shown in an upper part.

Further, in the present embodiment, the last sheet feed mode is a mode in which the printing sheet PS is stopped such that the nipping position NA where the printing sheet PS is nipped by the thermal head 15 and the platen roller 14 is located downstream of the terminal end SE of the printing sheets PS in the feeding direction. In FIG. 8, a stopped state in the last sheet feed mode is shown in a lower part.

First, the normal sheet feed mode is described.

FIG. 9 is a diagram showing the normal sheet feed mode in the printer 1 according to the present embodiment. An intermediate part of the continuous paper of the printing sheets supplied as the roll paper RP is shown in FIG. 9. FIG. 9 shows a positional relationship of the nipping position NA where the printing sheet PS is nipped by the thermal head 15 and the platen roller 14, the sensor 13 and the printing sheets PS in a planarly developed state.

In FIG. 9, a white arrow indicates the feeding direction of the printing sheets PS (continuous paper CP). It should be noted that only one of the pair of detection marks M, M' is shown in FIG. 9.

The positions of the printing sheets PS when an end part ME of the detection mark M is detected by the sensor 13 are shown in the upper part of FIG. 9, and the nipping position NA to be nipped by the thermal head 15 and the platen roller 14 is represented by a two-dot chain line on an upstream side of the boundary SB between the printing sheets PS in the feeding direction. An area represented by this two-dot chain line is referred to as a normal sheet holding position SA.

A state where the normal sheet holding position SA is located at the nipping position NA by feeding the printing sheets PS from the state in the upper part is shown in the lower part of FIG. 9.

In FIG. 9, D1 denotes a distance from the nipping position NA where the printing sheet PS is nipped by the platen roller 14 and the thermal head 15 to the sensor 13. To stop the normal sheet holding position SA upstream of the boundary SB between the printing sheets PS in the feeding direction at the nipping position NA, a control is executed to feed the printing sheets PS a distance D2 after the end part ME of the detection mark M of the printing sheet PS is detected.

An area of a dashed-dotted line in FIG. 9 represents a virtual printing region VE when the remaining print data, whose printing had not been completed when the detection marks M, M' of the printing sheet PS were detected, is completely printed. D3 denotes a feeding distance of the printing sheets PS until all the remaining print data, whose printing had not been completed when the detection marks M, M' of the printing sheet were detected, is completely printed.

Further, a broken line region drawn on the printing sheet PS represents a printable region PE where printing on the printing sheet PS is possible.

The control unit MC determines whether or not the remaining print data is printable in the printable region PE. Specifically, whether or not the virtual printing region VE is wider than the printable region PE is determined. The control unit MC determines that printing is impossible and stops printing on the printing sheet if the virtual printing region VE is wider than the printable region PE.

Next, the last sheet feed mode is described.

Figure 10:
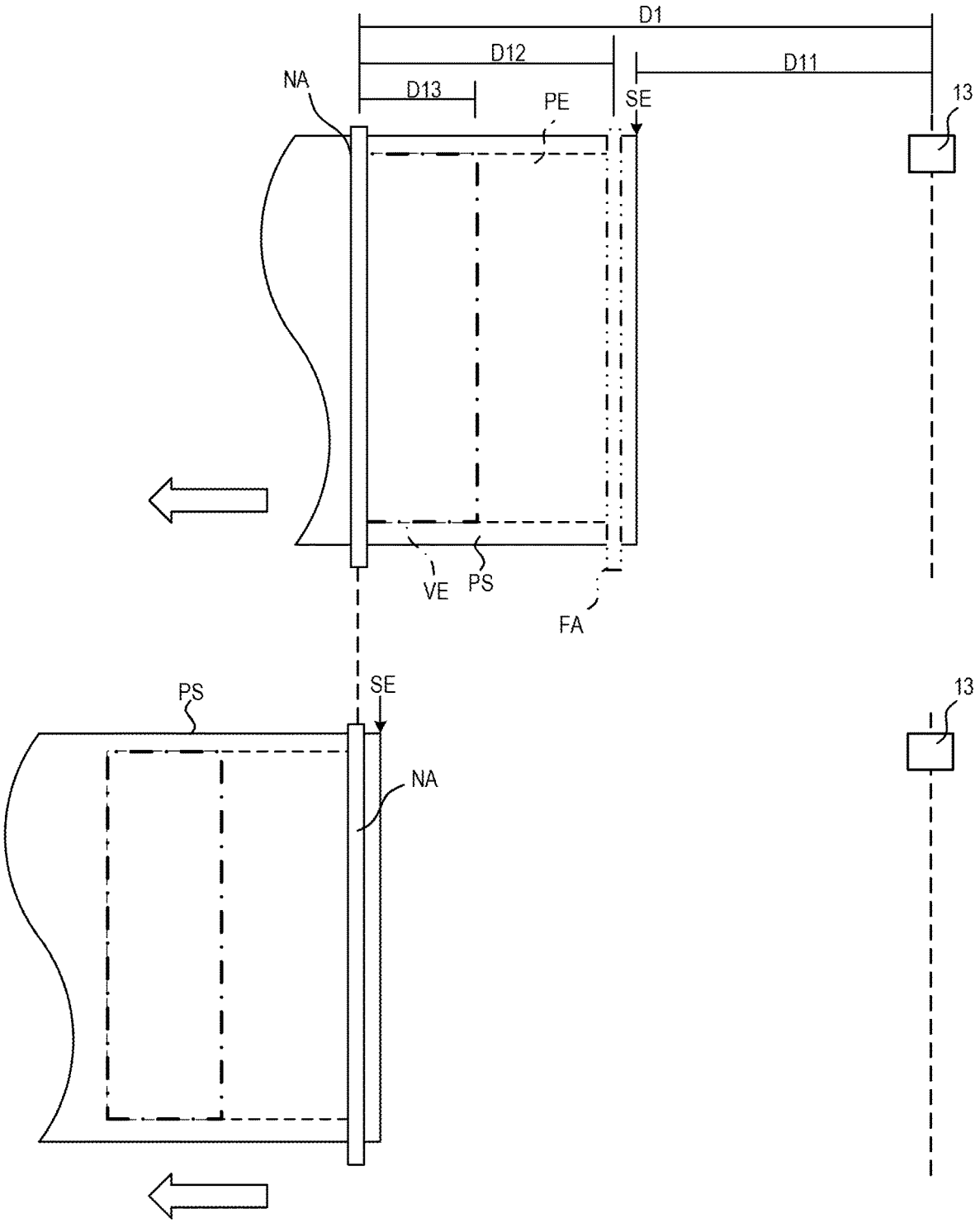
FIG. 10 is a diagram showing the last sheet feed mode in the printer according to the embodiment.

FIG. 10 is a diagram showing the last sheet feed mode in the printer 1 according to the present embodiment. The terminal end SE of the last one printing sheet (final printing sheet PS) of the continuous paper CP supplied as the roll paper RP is shown in FIG. 10. FIG. 10 shows a positional relationship of the nipping position NA where the printing sheet PS is nipped by the thermal head 15 and the platen roller 14, the sensor 13 and the printing sheet PS in a planarly developed state.

In FIG. 10, a direction of a white arrow indicates the feeding direction of the printing sheets PS (continuous paper CP).

The nipping position NA nipped by the thermal head 15 and the platen roller 14 is represented on a downstream side of the terminal end SE in the feeding direction by a two-dot chain line in an upper part of FIG. 10. A region represented by this two-dot chain line is referred to as a last sheet holding position FA.

A state where the last sheet holding position FA is located at the nipping position NA by feeding the printing sheet PS from the state in the upper part is shown in the lower part of FIG. 10.

When the terminal end SE of the printing sheets PS is detected by the sensor 13, the printing sheet PS has been fed a distance D11. Thus, to stop the last sheet holding position FA downstream of the terminal end SE of the printing sheets PS in the feeding direction at the nipping position NA, a control is executed to feed the printing sheet PS a distance D12 after the terminal end SE of the printing sheets PS is detected.

An area of a dashed-dotted line in FIG. 10 represents a virtual printing region VE when the remaining print data, whose printing had not been completed when the terminal end SE of the printing sheets PS was detected, is completely printed. D13 denotes a feeding distance of the printing sheet PS until the remaining print data, whose printing had not been completed when the terminal end SE of the printing sheets PS was detected, is completely printed.

A broken line region drawn on the printing sheet PS represents a printable region PE where printing on the printing sheet PS is possible.

The control unit MC determines whether or not the virtual printing region VE of the remaining print data is printable in the printable region PE, and sends a signal instructing a display urging an exchange of the roll paper RP to the display unit 26 when determining that printing is impossible. Then, after the roll paper RP is exchanged, the control unit MC stops the printing of the print data and performs a process of displaying a message urging a user to change a print layout on the display unit 26. In this way, the print data, which could not be printed, is printed on a new printing sheet PS.

In the two modes for feeding sheet described above, "feed a distance D2" or "feed a distance D12" can be realized by setting the rotating direction and the number of steps of the stepping motor 17.

The distance D2 or D12 differs depending on the type of the printing sheets PS. Thus, the feeding distance D2 of the printing sheets PS after the detection of the end part ME of the detection mark M of the printing sheet PS to stop the normal sheet holding position SA upstream of the boundary SB between the printing sheets PS in the feeding direction at the nipping position NA in FIG. 9 and the feeding distance D12 of the printing sheet PS after the detection of the terminal end SE of the printing sheets PS to stop the printing sheet PS at the last sheet holding position FA in FIG. 10 are stored, for example, in the ROM 31 or the like while being associated with each type of printing sheets PS to be used.

<Printing Sheet Feed Control—No. 1>

Figure 11:
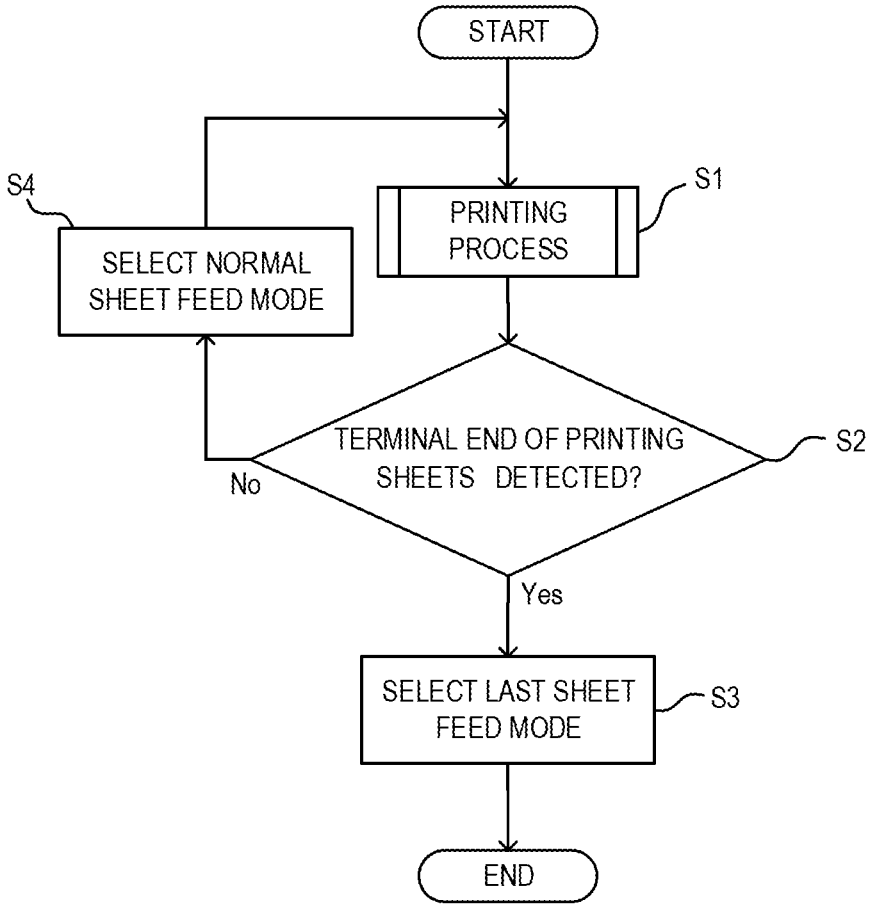
FIG. 11 is a flow chart showing a control method for printer implemented in a control unit of the printer according to the embodiment.

A printing sheet feed control executed in the printer 1 according to the embodiment of the present invention is described below. FIG. 11 is a flow chart showing a control method for printer implemented by the control unit MC of the printer 1.

The control unit MC in the printer 1 according to the present embodiment performs a printing process for printing print data on the printing sheet PS in Step S1.

In Step S2, the control unit MC determines whether or not the detected sheet part is the terminal end SE of the printing sheets PS. If the terminal end SE of the printing sheets PS is detected in Step S2, the control unit MC selects the last sheet feed mode in Step S3. Specifically, the control unit MC generates a control signal for stopping the last sheet holding position FA downstream of the terminal end SE of the printing sheets PS in the feeding direction at the nipping position NA and sends this control signal to the feed control circuit 33. In this way, the printing sheet PS is fed and stopped such that the downstream side of the terminal end SE of the printing sheets PS in the feeding direction is located at the nipping position NA.

If the terminal end SE of the printing sheets PS is not detected in Step S2, the control unit MC selects the normal sheet feed mode in Step S4. Specifically, the control unit MC generates a control signal for stopping the normal sheet holding position SA upstream of the boundary SB between the printing sheets PS in the feeding direction at the nipping position NA and sends this control signal to the feed control circuit 33. In this way, the printing sheets PS are fed and stopped such that the upstream side of the boundary SB between the printing sheets PS in the feeding direction is located at the nipping position NA. Then, the control unit MC repeatedly performs the printing process for the next printing sheet PS.

According to a series of steps described above, the printer 1 stops the last sheet holding position FA downstream of the terminal end SE of the printing sheets PS in the feeding direction at the nipping position NA when detecting the terminal end SE of the printing sheets PS. In this way, the downstream side of the terminal end SE of the last printing sheet PS is nipped by the thermal head 15 and the platen roller 14.

Further, according to the printer 1, the normal sheet holding position SA upstream of the boundary SB between the printing sheets PS in the feeding direction is stopped at the nipping position NA if the terminal end SE of the printing sheets PS is not detected, i.e. if the printing sheet PS is not the last sheet. In this way, the continuous paper CP of the printing sheets PS is nipped on the upstream side of the boundary SB in the feeding direction by the thermal head 15 and the platen roller 14.

<Printing Sheet Feed Control—No. 2>

Figure 12:
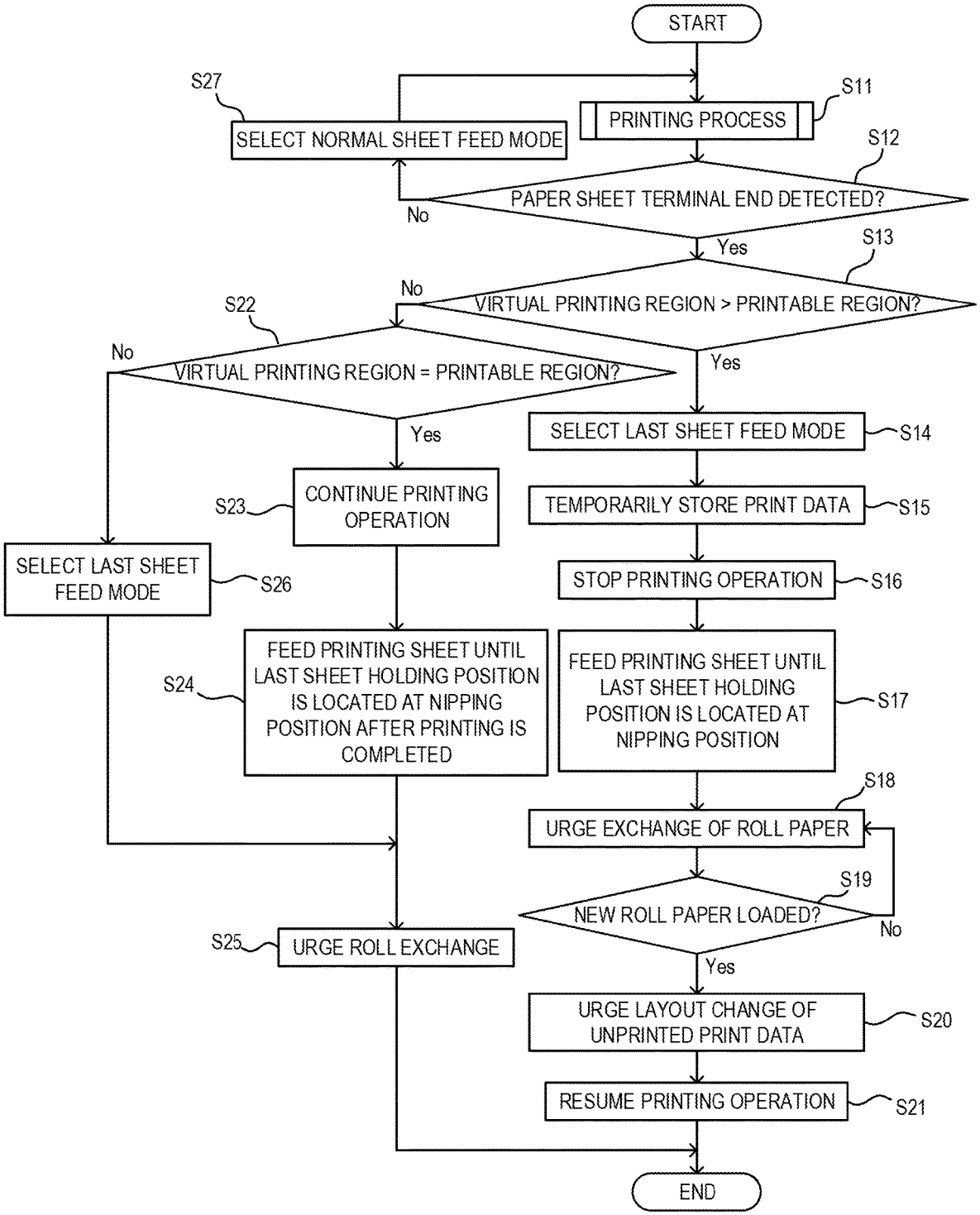
FIG. 12 is a flow chart showing a control method for printer implemented in the control unit of the printer according to the embodiment.

Another embodiment of the printing sheet feed control executed in the printer 1 according to the present embodiment is described next. FIG. 12 is a flow chart showing a control method for printer implemented by the control unit MC of the printer 1.

The control unit MC in the printer 1 performs a printing process for printing print data on the printing sheet PS in Step S11.

In Step S12, the control unit MC determines whether or not the detected sheet part is the terminal end SE of the printing sheets PS. If the terminal end SE of the printing sheets PS is detected in Step S12, the control unit MC further compares the virtual printing region VE by the remaining printing step and the printable region PE remaining on the printing sheet PS in Step S13.

If the virtual printing region VE by the remaining printing step is wider than the printable region PE in Step S13, the control unit MC selects the last sheet feed mode in Step S14.

Subsequently, the print data is temporarily stored in a work area in Step S15 and a printing operation is temporarily stopped in Step S16.

Subsequently, in Step S17, the control unit MC generates a control signal for stopping the last sheet holding position FA downstream of the terminal end SE of the printing sheets PS in the feeding direction at the nipping position NA and sends this control signal to the feed control circuit 33. In this way, the printing sheet PS is fed and stopped such that the downstream side of the terminal end SE of the printing sheets PS in the feeding direction is located at the nipping position NA. Thereafter, in Step S18, the control unit MC generates a signal urging an exchange of the roll paper and supplies this signal to the display unit 26.

Subsequently, the control unit MC determines in Step S19 whether or not new roll paper RP has been loaded. If the new roll paper RP has been loaded in Step S19, the control unit MC urges a layout change of the print data to the user so that all the temporarily stored print data can be printed in the printable region PE. Then, in Step S21, the printing operation is resumed and printing is completed on the basis of the changed print layout.

If the terminal end SE of the printing sheets PS has been detected in Step S12 and the virtual printing region VE by the remaining printing step is narrower than the printable region PE in Step S13, the control unit MC further determines whether or not the virtual printing region VE by the remaining printing step is accommodated in the printable region PE at the last sheet holding position FA. Specifically, whether the virtual printing region VE by the remaining printing step is equal to or smaller than the printable region PE is determined.

A case where the virtual printing region VE by the remaining printing step is smaller than the printable region PE in Step S22 is a case where the printable region PE still has a margin even after the remaining printing step is completed. In this case, the control unit MC continues the printing operation in Step S23.

Then, in Step S24 the control unit MC stops the last sheet holding position FA at the nipping position NA after all the print data is completely printed.

Subsequently, in Step S25, the control unit MC generates a signal urging an exchange of the roll paper RP and supplies this signal to the display unit.

On the other hand, if the virtual printing region VE by the remaining printing step is equal to the printable region PE in Step S22, the control unit MC stops the last sheet holding position FA at the nipping position NA in Step S25 after the remaining print data is printed in the printable region PE. Subsequently, in Step S26, the control unit MC generates a signal urging an exchange of the roll paper RP and supplies this signal to the display unit 26.

Further, if the terminal end SE of the printing sheets PS is not detected in Step S12, the control unit MC selects the normal sheet feed mode in Step S27. Specifically, the printing sheets PS are fed until the upstream side of the boundary SB between the printing sheets PS in the feeding direction is located at the nipping position NA, and stopped. Then, the control unit MC repeatedly performs the printing process for the next printing sheet PS.

According to a series of steps described above, the printer 1 stops the last sheet holding position FA downstream of the terminal end SE of the printing sheets PS in the feeding direction at the nipping position NA when detecting the terminal end SE of the printing sheets PS. In this way, the downstream side of the terminal end SE of the last printing sheet PS is nipped by the thermal head 15 and the platen roller 14.

Further, according to the printer 1, if the printing sheet PS is the last printing sheet PS and printing cannot be performed on the printable region PE of the last printing sheet PS, printing is stopped. The print data determined not to be printable is temporarily stored and a message urging the user to change the print layout is displayed on the display unit after an exchange of the roll paper RP.

Further, according to the printer 1, the normal sheet holding position SA upstream of the boundary SB between the printing sheets PS in the feeding direction is stopped at the nipping position NA if the printing sheet PS is not the last sheet. In this way, the continuous paper CP of the printing sheets PS is nipped on the upstream side of the boundary SB in the feeding direction by the thermal head 15 and the platen roller 14.

Next, a process in a case where the printing process is not accompanied, i.e. a case where only an operation of feeding out the print sheet PS is performed by the user, is described.

Figure 13:
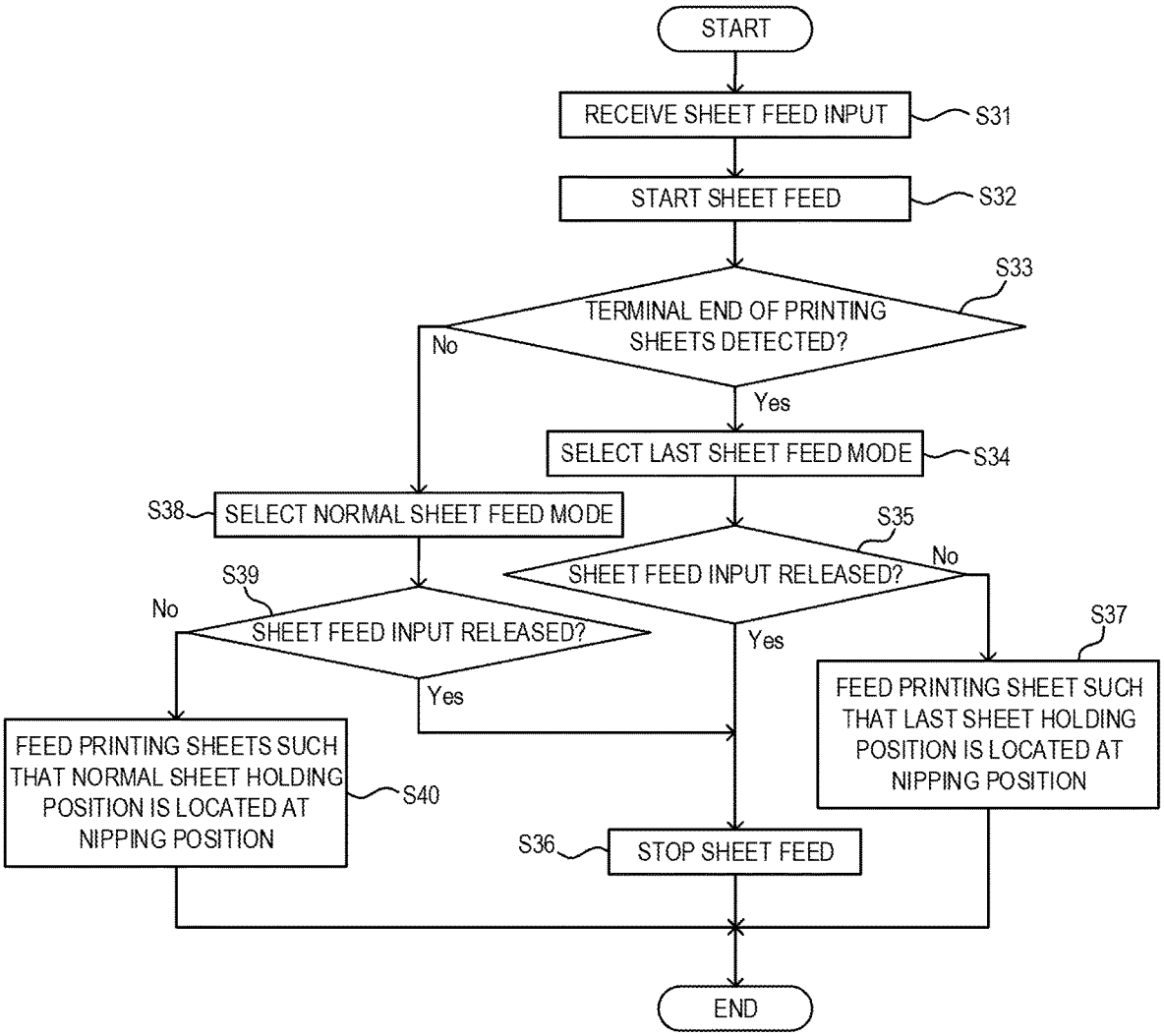
FIG. 13 is a flow chart showing a control method for printer, which is not accompanied by printing, implemented in the control unit of the printer according to the embodiment.

FIG. 13 is a flow chart showing a control method for printer, not accompanied by printing, implemented by the control unit MC of the printer 1.

When the control unit MC receives a sheet feed input for feeding the printing sheets PS in Step S31, the control unit MC starts the sheet feed in Step S32.

In Step S33, the control unit MC determines whether or not the detected sheet part is the terminal end SE of the printing sheets PS. If the terminal end SE of the printing sheets PS is detected in Step S33, the control unit MC selects the last sheet feed mode in Step S34.

In Step S35, the control unit MC determines whether or not the sheet feed input has been released. If the sheet feed input has been released in Step S35, the sheet feed is stopped in Step S36.

Even if the sheet feed input has not been released in Step S35, the control unit MC feeds and stops the printing sheet PS such that the last sheet holding position FA downstream of the terminal end SE of the printing sheets PS in the feeding direction is located at the nipping position NA where the printing sheet PS is nipped by the thermal head 15 and the platen roller 14 in Step S37.

If the terminal end SE of the printing sheets PS is not detected in Step S33, the control unit MC selects the normal sheet feed mode in Step S38.

Subsequently, in Step S39, the control unit MC determines whether or not the sheet feed input has been released. If it is determined in Step S39 that the sheet feed input has been released, the sheet feed is stopped in Step S36.

If it is determined in Step S39 that the sheet feed input is not released, the control unit MC feeds and stops the printing sheets PS such that the normal sheet holding position SA upstream of the boundary SB between the printing sheets PS is located at the nipping position NA in Step S40.

[Effects]

As described above, the printer 1 according to the embodiment of the present invention stops the last sheet holding position FA downstream of the terminal end SE of the printing sheets PS in the feeding direction at the nipping position NA when detecting the terminal end SE of the printing sheets PS. In this way, the downstream side of the terminal end SE of the last printing sheet PS in the feeding direction is nipped at the nipping position NA by the thermal head 15 and the platen roller 14.

Accordingly, the continuous paper can be used up to the terminal end SE of the last printing sheets PS and the printing sheet PS after printing does not drop from the issue port of the printer 1. Further, this is preferable also in terms of reducing environmental burdens since the last printing sheet PS is not wasted.

Further, according to the printer 1, if the printing sheet PS is the last printing sheet PS and the print data is determined not to be printable in the printable region PE of the last printing sheet PS, the print data is temporarily stored and printed again after the print layout is changed by the user after an exchange of the roll paper RP. Thus, even if the roll paper RP runs out, there is no possibility of missing the print data.

Further, according to the printer 1 of the present embodiment, the printing sheets PS are fed and, thereafter, stopped such that the normal sheet holding position SA upstream of the boundary SB between the printing sheets PS in the feeding direction is stopped at the nipping position NA if the printing sheet PS is not the last printing sheet PS. In this way, the continuous paper CP of the printing sheets PS is nipped by the thermal head 15 and the platen roller 14 on the upstream side of the boundary SB in the feeding direction, wherefore the user can easily cut off the printing sheet PS at the boundary SB by pulling the printing sheet PS exposed from the issue port in a pull-out direction.

Further, if the detection marks M for detecting the boundaries SB between the printing sheets PS are provided at predetermined positions of the printing sheet PS according to the present embodiment, the control unit MC stops the printing sheets PS such that the upstream side of the boundary SB between the printing sheets PS in the feeding direction is located at the nipping position NA where the printing sheet PS is nipped by the thermal head 15 and the platen roller 14 if the detection mark M is detected by the sensor 13.

Further, according to the printer 1 of the present embodiment, if the printing sheet PS is the last printing sheet PS and printing cannot be performed on the printable region PE of the last printing sheet PS, the print data determined not to be printable is temporarily stored and printed on a new printing sheet PS after the print layout is changed by the user after an exchange of the roll paper RP. Thus, even if the roll paper RP runs out, there is no possibility of missing the print data.

Further, according to the printer 1 of the present embodiment, even if the feed of the printing sheets PS is designated by the user and the last printing sheet PS is reached without an operation input for sheet feed being released, the downstream side of the terminal end SE of the printing sheets PS in the feeding direction can be stopped at the nipping position NA by the thermal head 15 and the platen roller 14. Thus, the printing sheet PS does not drop from the issue port.

Further, if the feed of the printing sheets PS is designated and the boundary SB between the printing sheets PS is reached without an operation input for sheet feed being released, the upstream side of the boundary SB between the printing sheets PS in the feeding direction can be stopped at the nipping position NA by the thermal head 15 and the platen roller 14. Thus, the printing sheet PS can be easily cut off.

Other Embodiments

In the present embodiment, the control unit MC may perform a process of changing the print layout so that printing can be performed in the printable region PE after printing on the printing sheet PS is stopped if it is determined that the virtual printing region VE by the remaining print data, whose printing had not been completed when the detection marks M, M' of the printing sheet PS were detected, cannot be printed in the printable region PE.

Here, changes of the print layout include a font reduction and an increase in line feed.

A pair of the detection marks M, M' and a pair of the designation marks N, N' are provided in the width direction of the printing sheet PS. However, these marks may be provided only on either one of side edges of the printing sheet PS.

In the printer 1 according to the present embodiment, if the designation marks N, N' shown in FIG. 6 are provided, the printing of designated print data can be started when the designation marks N, N' are detected by determining the designated print data to be printed on the printing sheet PS in correspondence with the designation marks N, N'.

As printing proceeds from the leading end of the printing sheet PS to a rear half, errors of the feeding operation of the platen roller 14 and the like are accumulated. Thus, the print data to be printed may deviate from a predetermined printing position.

In contrast, the designation marks N, N' for designating the print data are provided downstream of the detection marks M, M' in the feeding direction and the printing of the designated print data can be started, independently of a count number from the printing leading end position, if the designated print data to be printed is determined in correspondence with the designation marks N, N'. Thus, even if the printing position deviates before the designation marks N, N' are reached, the printing position can be corrected at the position of the designation marks N, N'. In this way, accuracy in aligning the printing position is improved as compared to the case where the detection marks M, M' are provided at one position in a longitudinal direction of the printing sheet PS.

By improving the accuracy in aligning the printing position, it is possible to improve accuracy in stopping the last sheet holding position FA downstream of the terminal end SE of the printing sheets PS in the feeding direction at the nipping position NA by the thermal head 15 and the platen roller 14 and accuracy in stopping the normal sheet holding position SA upstream of the boundary SB between the printing sheets PS in the feeding direction at the nipping position NA.

Although the embodiment of the present invention has been described above, the above embodiment is merely an illustration of one application example of the present invention and not intended to limit the technical scope of the present invention to the specific configuration of the above embodiment.

The present application claims a priority based on Japanese Patent Application No. 2016-191011 filed with the Japan Patent Office on Sep. 29, 2016, all the contents of which are hereby incorporated by reference.

The invention claimed is:

1. A printer for printing on roll paper formed by winding continuous paper of printing sheets sectioned at predetermined intervals, comprising:

a thermal head configured to print on the printing sheet;

a platen roller provided to face the thermal head, the platen roller being configured to nip the printing sheet between the thermal head and the platen roller and feed the printing sheet;

a detection unit provided upstream of the platen roller in a feeding direction of the printing sheets, the detection unit being configured to detect a detection mark which is provided at a predetermined position of the printing sheet and which is for detecting a boundary between the printing sheets; and a control unit configured to feed the printing sheets, perform printing on the printing sheet and stop the printing sheets such that an upstream side of a boundary between the printing sheets in the feeding direction is located at a nipping position where the printing sheet is nipped by the thermal head and the platen roller after the printing is completed if the detection mark is detected by the detection unit, the control unit being configured to determine that a terminal end of the last printing sheet in the roll paper has been detected, feed the last printing sheet, perform printing on the last printing sheet and stop the last printing sheet such that a downstream side of the terminal end of the last printing sheet in the feeding direction is located at the nipping position where the printing sheet is nipped by the thermal head and the platen roller after the printing is completed if the detection mark is not detected by the detection unit.

2. The printer according to claim 1, wherein:

the control unit stops printing on the last printing sheet before the last printing sheet is stopped such that the downstream side of the terminal end of the last printing sheet in the feeding direction is located at the nipping position where the printing sheet is nipped by the thermal head and the platen roller after the last printing sheet is fed if the terminal end of the last printing sheet is detected.

3. The printer according to claim 2, wherein:

a designation mark for designating a printing position of print data on the printing sheet is provided downstream of the detection mark in the feeding direction;

designated print data to be printed in correspondence with the designation mark is determined for the print data to be printed on the printing sheet; and the control unit starts printing the designated print data if the designation mark is detected.

4. The printer according to claim 1, wherein:

a designation mark for designating a printing position of print data on the printing sheet is provided downstream of the detection mark in the feeding direction;

designated print data to be printed in correspondence with the designation mark is determined for the print data to be printed on the printing sheet; and the control unit starts printing the designated print data if the designation mark is detected.

5. A control method for a printer with a thermal head configured to print on roll paper formed by winding continuous paper of printing sheets sectioned at predetermined intervals, a platen roller provided to face the thermal head and configured to nip the printing sheet between the thermal head and the platen roller and feed the printing sheet, and a detection unit provided upstream of the platen roller in a feeding direction of the printing sheets and configured to detect a detection mark for detecting a boundary between the printing sheets, wherein:

the printing sheets are fed, printing is performed on the printing sheet and the printing sheets are stopped such that an upstream side of a boundary between the printing sheets in the feeding direction is located at a nipping position where the printing sheet is nipped by the thermal head and the platen roller after the printing is completed if the detection mark is detected by the detection unit, it is determined that a terminal end of the last printing sheet in the roll paper has been detected, the last printing sheet is fed, printing is performed on the last printing sheet and the last printing sheet is stopped such that a downstream side of the terminal end of the sheet is nipped by the thermal head and the platen roller after the printing is completed if the detection mark is not detected by the detection unit.

* * * * *